US011753974B2

(12) United States Patent
Dudar

(10) Patent No.: US 11,753,974 B2
(45) Date of Patent: Sep. 12, 2023

(54) METHODS AND SYSTEM FOR DE-ICING A VALVE OF AN EXHAUST SYSTEM

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/453,792

(22) Filed: Nov. 5, 2021

(65) Prior Publication Data

US 2023/0147854 A1 May 11, 2023

(51) Int. Cl.

| | |
|---|---|
| ***F01N 1/16*** | (2006.01) |
| ***F01N 1/18*** | (2006.01) |
| ***F01N 13/08*** | (2010.01) |

(52) U.S. Cl.

CPC ..... *F01N 1/163* (2013.01); *F01N 1/165* (2013.01); *F01N 1/168* (2013.01); *F01N 13/08* (2013.01)

(58) Field of Classification Search

CPC . F01N 1/16; F01N 1/163; F01N 1/161; F01N 1/165; F01N 1/166; F01N 1/168; F01N 1/18; F01N 13/08; F01N 13/087; F02D 11/107; F02D 11/10; F02D 2200/00; F02D 2200/04; F02D 2200/0414; F02D 2200/0418; F02D 2200/0416; F02D 2011/108

See application file for complete search history.

(56) References Cited

U.S. PATENT DOCUMENTS

| | | | | |
|---|---|---|---|---|
| 6,701,891 | B2 * | 3/2004 | Niki | F02D 11/107 123/399 |
| 7,114,487 | B2 | 10/2006 | Hedrick et al. | |
| 7,210,452 | B2 | 5/2007 | Nakashima et al. | |
| 7,434,565 | B2 * | 10/2008 | Miyachi | F02D 41/107 123/399 |
| 7,434,566 | B2 * | 10/2008 | McKay | F02D 41/042 123/399 |
| 7,509,939 | B2 | 3/2009 | Asano et al. | |

(Continued)

FOREIGN PATENT DOCUMENTS

| | | | |
|---|---|---|---|
| CN | 204060994 U | | 12/2014 |
| CN | 113202636 A | * | 8/2021 |

(Continued)

OTHER PUBLICATIONS

"New Mustang GT Owners Can Now Hush the V8 Growl to be Good Neighbors; Brush with the Law Gave Engineer the Idea," Ford Media Website, Available Online at https://media.ford.com/content/fordmedia/fna/us/en/news/2017/08/01/mustang-gt-quiet-start-mode.html. Aug. 1, 2017, 3 pages.

*Primary Examiner* — Edgardo San Martin

(74) *Attorney, Agent, or Firm* — Vincent Mastrogiacomo; McCoy Russell LLP

(57) ABSTRACT

Systems and methods for operating an engine that includes an exhaust tuning valve in its exhaust system are described. In one example, a position of the exhaust tuning valve may be adjusted to reduce a possibility of the exhaust tuning valve becoming stuck due to freezing water. In particular, the exhaust tuning valve may be cycled as ambient temperature approaches a temperature at which water freezes.

19 Claims, 5 Drawing Sheets

(56) References Cited

U.S. PATENT DOCUMENTS

| | | | | |
|---|---|---|---|---|
| 8,474,310 | B2 * | 7/2013 | Fujimoto | F02D 19/084 73/114.74 |
| 8,833,384 | B2 | 9/2014 | Burt | |
| 8,849,503 | B1 | 9/2014 | Dudar | |
| 10,100,751 | B2 | 10/2018 | Mantovano et al. | |
| 10,145,340 | B1 * | 12/2018 | Dudar | F02D 41/0002 |
| 10,844,762 | B2 * | 11/2020 | Dadam | F01N 1/166 |
| 2022/0136468 | A1 * | 5/2022 | Matoba | F02D 13/0226 701/102 |

FOREIGN PATENT DOCUMENTS

| | | | | |
|---|---|---|---|---|
| CN | 113685283 | A | * | 11/2021 |
| DE | 102006005794 | B4 | | 7/2014 |
| DE | 102018212231 | A1 | * | 1/2020 |

* cited by examiner

METHODS AND SYSTEM FOR DE-ICING A VALVE OF AN EXHAUST SYSTEM

FIELD

The present description relates to methods and a system for de-icing a valve in an exhaust system of an internal combustion engine.

BACKGROUND AND SUMMARY

An engine may be equipped with an exhaust system that includes an exhaust tuning valve. The exhaust tuning valve may change an exhaust note or the sound of exhaust passing through the vehicle's exhaust system. The exhaust tuning valve may open to direct exhaust gases through a lower resistance passage, thereby increasing exhaust noise. On the other hand, the exhaust tuning valve may be closed to route exhaust gas through sound deadening chambers that tend to reduce exhaust noise. However, when ambient temperatures are near or less than a temperature at which water freezes, the exhaust tuning valve may stick in a fully closed position. If the exhaust tuning valve does not operate as expected due to freezing, the vehicle's operator may become concerned that the vehicle is operating improperly. In addition, diagnostic trouble codes may be set within a vehicle controller, which may cause additional concern for the vehicle's operator.

The inventor herein has recognized the above-mentioned issues and has developed a method for operating an engine, comprising: adjusting a position of a valve in an exhaust system of the engine via a controller in response to ambient temperature being within a threshold temperature of a temperature at which water freezes and ambient relative humidity being greater than a threshold relative humidity.

By adjusting a position of a valve in an exhaust system of an engine before ambient temperature reaches a temperature at which water freezes when ambient humidity is greater than a threshold, it may be possible to clear water from an area where the valve seats to the exhaust system so that a possibility of a stuck valve in the exhaust system may be avoided. In addition, a minimum opening amount of the valve in the exhaust system may be increased so that if there is water in the exhaust system, less surface area may be provided for the water to freeze and couple the valve to the exhaust system.

The present description may provide several advantages. In particular, the approach may prevent transient diagnostic codes from being displayed. Further, the approach may improve customer satisfaction. In addition, the approach may reduce vehicle warranty costs.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

The present description is related to operating a vehicle that includes a valve in an exhaust system of an internal combustion engine. A position of the valve may be adjusted to provide a varying exhaust note. The valve may be subject to operating conditions that may cause the valve to freeze in an open or closed position. The valve may be included in an exhaust system of an engine of the type shown in FIG. 1. The engine may be included in a hybrid vehicle of the type shown in FIG. 2 or another known type of hybrid vehicle. The valve and engine may be operated as shown in the sequence of FIG. 3 according to the method of FIG. 4. A controller may wake and operate the valve according to input from an electrical circuit as shown in FIG. 5 or via an alternative circuit.

Figure 1:
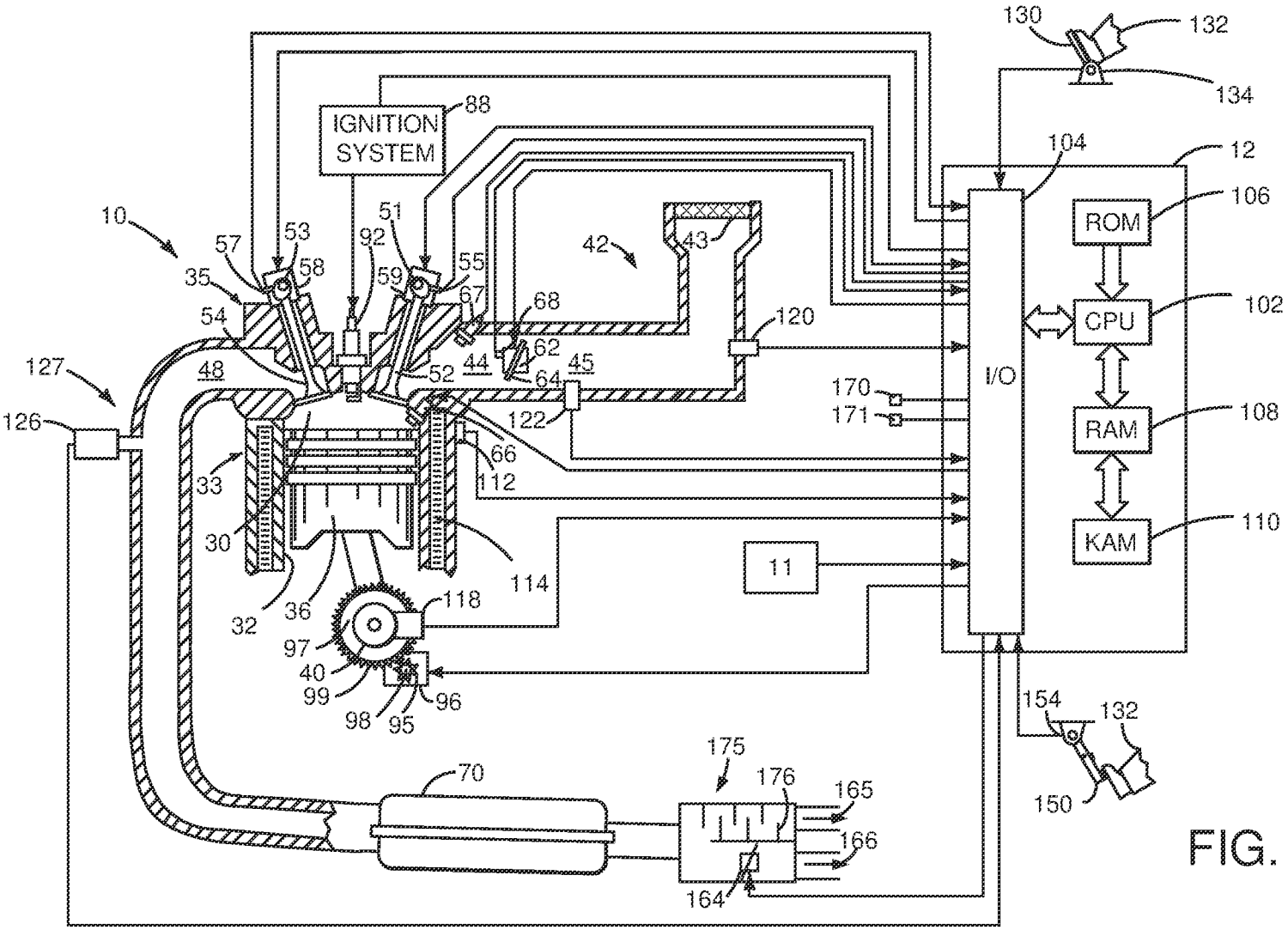
FIG. 1 is a schematic diagram of an engine.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1 and 2. The controller 12 employs the actuators shown in FIGS. 1 and 2 to adjust engine and driveline operation based on the received signals and instructions stored in memory of controller 12.

Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply power to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electro-mechanical devices.

Direct fuel injector 66 is shown positioned to inject fuel directly into cylinder 30, which is known to those skilled in the art as direct injection. Port fuel injector 67 is shown positioned to inject fuel into the intake port of cylinder 30, which is known to those skilled in the art as port injection.

Fuel injectors 66 and 67 deliver liquid fuel in proportion to pulse widths provided by controller 12. Fuel is delivered to fuel injectors 66 and 67 by a fuel system (not shown) including a fuel tank, fuel pump, and fuel rail (not shown).

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Combustion gases may exit engine 10 and enter exhaust system 127. Exhaust system 127 includes an exhaust manifold, a universal exhaust gas oxygen (UEGO) sensor 126, and a three-way catalyst 70. The exhaust sensor 126 is located upstream of three-way catalyst 70 according to a direction of exhaust gas flow. In some examples, a two-state exhaust gas oxygen sensor may be substituted for UEGO sensor 126.

Three-way catalyst 70 may include multiple bricks. An exhaust tuning valve 175 is positioned downstream of three-way catalyst 70. The exhaust tuning valve 175 may include a butterfly valve 164 in a first passage 166 and baffling 176 in a second passage 165. Substantially all engine exhaust may flow through second passage 165 when butterfly valve 164 is in a closed position. Substantially all engine exhaust may flow through first passage 166 when butterfly valve 164 is fully open. A sound level of exhaust flowing through second passage 165 may be muffled or reduced. A sound level of exhaust flowing through first passage 166 may be less muffled or reduced as compared to if the exhaust flowed through the second passage 165.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 (e.g., a human/machine interface) for sensing force applied by human driver 132; a position sensor 154 coupled to brake pedal 150 (e.g., a human/machine interface) for sensing force applied by human driver 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; a measurement of ambient temperature via temperature sensor 170; a measurement of ambient humidity (e.g., relative humidity) from humidity sensor 171; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start the engine or vehicle may be generated via a human and input to the human/machine interface 11. The human/machine interface 11 may be a touch screen display, pushbutton, key switch or other known device.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational power of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
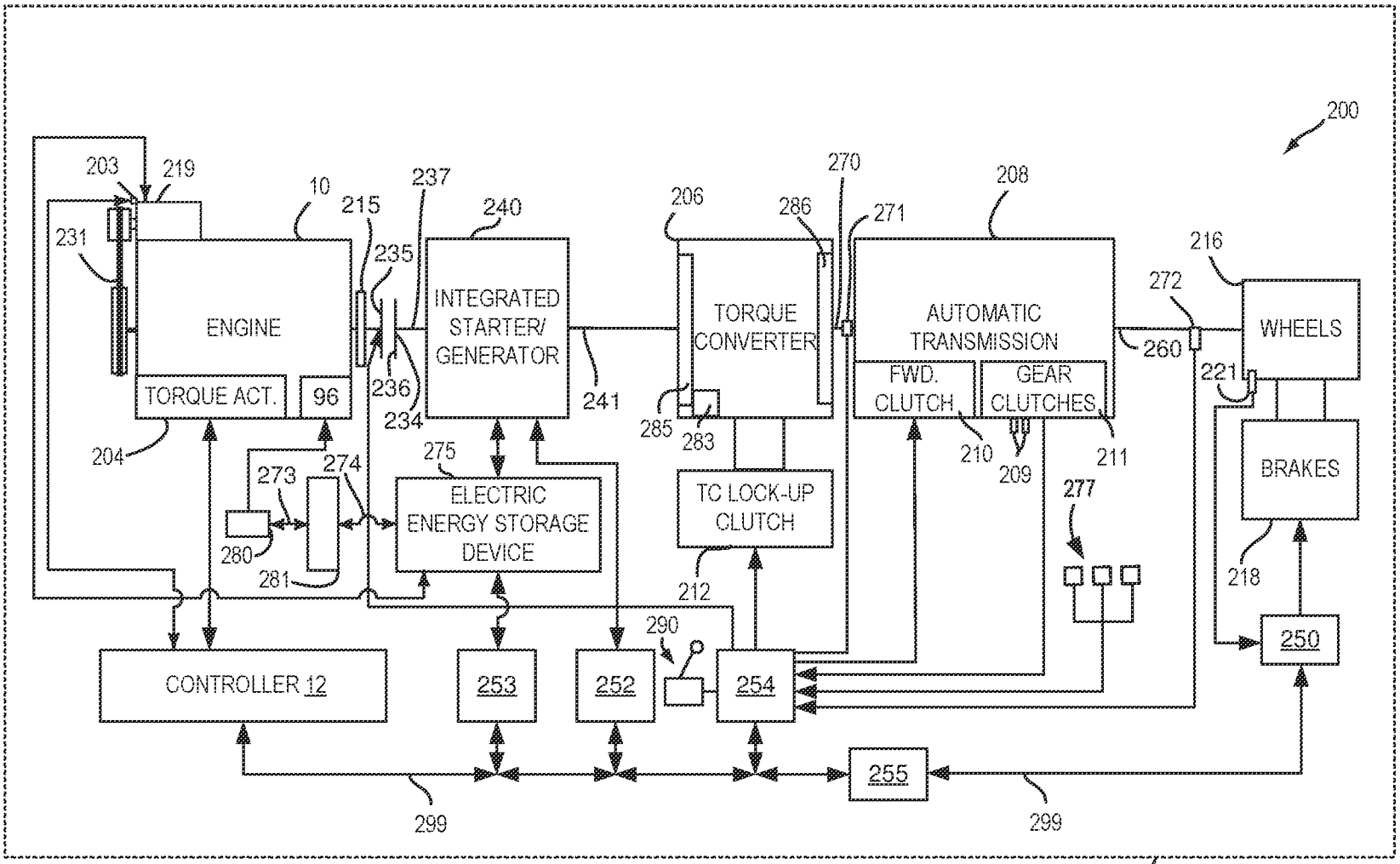
FIG. 2 is a schematic diagram of a hybrid vehicle driveline.
Figure 3:
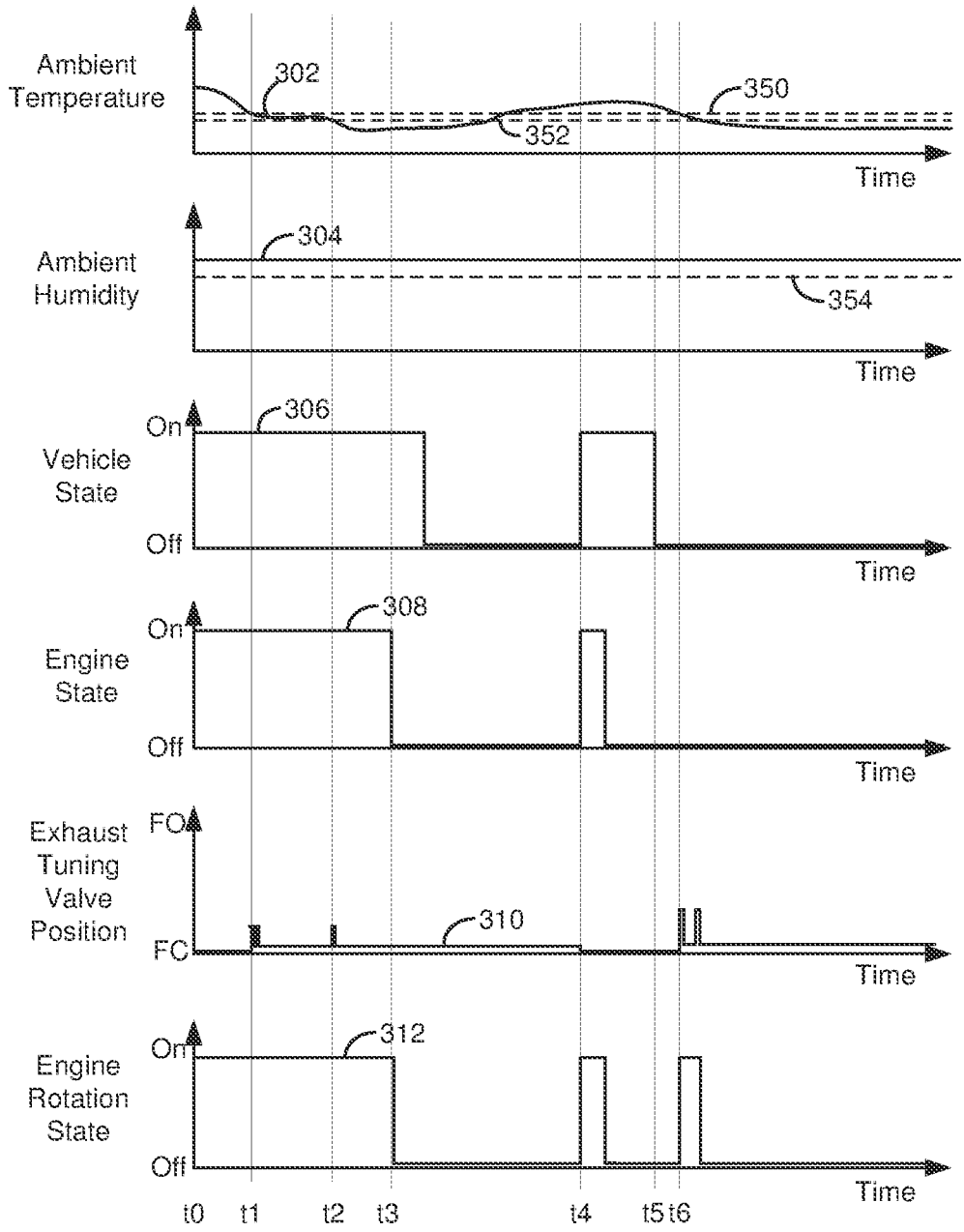
FIG. 3 is a plot of an example vehicle operating sequence according to the method of FIG. 4.

FIG. 2 is a block diagram of a vehicle 225 including a powertrain or driveline 200. The powertrain of FIG. 2 includes engine 10 shown in FIG. 1. Powertrain 200 is shown including vehicle system controller 255, engine controller 12, electric machine controller 252, transmission controller 254, energy storage device controller 253, and brake controller 250. The controllers may communicate over controller area network (CAN) 299. Each of the controllers may provide information to other controllers such as power output limits (e.g., power output of the device or component being controlled not to be exceeded), power input limits (e.g., power input of the device or component being controlled not to be exceeded), power output of the device being controlled, sensor and actuator data, diagnostic information (e.g., information regarding a degraded transmission, information regarding a degraded engine, information regarding a degraded electric machine, information regarding degraded brakes). Further, the vehicle system controller 255 may provide commands to engine controller 12, electric machine controller 252, transmission controller 254, and brake controller 250 to achieve driver input requests and other requests that are based on vehicle operating conditions.

For example, in response to a driver releasing an accelerator pedal and vehicle speed, vehicle system controller 255 may request a desired wheel power or a wheel power level to provide a desired rate of vehicle deceleration. The requested desired wheel power may be provided by vehicle system controller 255 requesting a first braking power from electric machine controller 252 and a second braking power from engine controller 12, the first and second powers providing a desired driveline braking power at vehicle wheels 216. Vehicle system controller 255 may also request a friction braking power via brake controller 250. The braking powers may be referred to as negative powers since they slow driveline and wheel rotation. Positive power may maintain or accelerate driveline and wheel rotation.

In other examples, the partitioning of controlling powertrain devices may be partitioned differently than is shown in FIG. 2. For example, a single controller may take the place of vehicle system controller 255, engine controller 12, electric machine controller 252, transmission controller 254, and brake controller 250. Alternatively, the vehicle system controller 255 and the engine controller 12 may be a single unit while the electric machine controller 252, the transmission controller 254, and the brake controller 250 are standalone controllers.

In this example, powertrain 200 may be powered by engine 10 and electric machine 240. In other examples, engine 10 may be omitted. Engine 10 may be started with an engine starting system shown in FIG. 1, via BISG 219, or via driveline integrated starter/generator (ISG) 240 also known as an integrated starter/generator. A speed of BISG 219 may be determined via optional BISG speed sensor 203. Driveline ISG 240 (e.g., high voltage (operated with greater than 30 volts) electrical machine) may also be referred to as an electric machine, motor, and/or generator. Further, power of engine 10 may be adjusted via power actuator 204, such as a fuel injector, throttle, etc.

BISG 219 is mechanically coupled to engine 10 via belt 231. BISG may be coupled to crankshaft 40 or a camshaft (e.g., 51 or 53 of FIG. 1). BISG may operate as a motor when supplied with electrical power via electric energy storage device 275 or low voltage battery 280. BISG may operate as a generator supplying electrical power to electric energy storage device 275 or low voltage battery 280. Bi-directional DC/DC converter 281 may transfer electrical energy from a high voltage buss 274 to a low voltage buss 273 or vice-versa. Low voltage battery 280 is electrically coupled to low voltage buss 273. Electric energy storage device 275 is electrically coupled to high voltage buss 274. Low voltage battery 280 selectively supplies electrical energy to starter motor 96.

An engine output power may be transmitted to an input or first side of powertrain disconnect clutch 235 through dual mass flywheel 215. Disconnect clutch 236 may be electrically or hydraulically actuated. The downstream or second side 234 of disconnect clutch 236 is shown mechanically coupled to ISG input shaft 237.

Disconnect clutch 236 may be fully closed when engine 10 is supplying power to vehicle wheels 216. Disconnect clutch 236 may be fully open when engine 10 is stopped (e.g., not combusting fuel) or when engine 10 is supplying power to BISG 219 and BISG 219 is generating electrical charge to charge electric energy storage device 275 or supplying electrical charge to ISG 240.

ISG 240 may be operated to provide power to powertrain 200 or to convert powertrain power into electrical energy to be stored in electric energy storage device 275 in a regeneration mode. In addition, ISG 240 may rotate engine 10 from a position where the engine has stopped rotating to start or motor the engine. ISG 240 is in electrical communication with energy storage device 275. ISG 240 has a higher output power capacity than starter 96 shown in FIG. 1 or BISG 219. Further, ISG 240 directly drives powertrain 200 or is directly driven by powertrain 200. There are no belts, gears, or chains to couple ISG 240 to powertrain 200. Rather, ISG 240 rotates at the same rate as powertrain 200. Electrical energy storage device 275 (e.g., high voltage battery or power source) may be a battery, capacitor, or inductor. The downstream side of ISG 240 is mechanically coupled to the impeller 285 of torque converter 206 via shaft 241. The upstream side of the ISG 240 is mechanically coupled to the disconnect clutch 236. ISG 240 may provide a positive power or a negative power to powertrain 200 via operating as a motor or generator as instructed by electric machine controller 252.

Torque converter 206 includes a turbine 286 to output power to input shaft 270. Input shaft 270 mechanically couples torque converter 206 to automatic transmission 208. Torque converter 206 also includes a torque converter bypass lock-up clutch 212 (TCC). Power is directly transferred from impeller 285 to turbine 286 when TCC is locked. TCC is electrically operated by controller 12. Alternatively, TCC may be hydraulically locked. In one example, the torque converter may be referred to as a component of the transmission.

When torque converter lock-up clutch 212 is fully disengaged, torque converter 206 transmits engine power to automatic transmission 208 via fluid transfer between the torque converter turbine 286 and torque converter impeller 285, thereby enabling power multiplication. In contrast, when torque converter lock-up clutch 212 is fully engaged, the engine output power is directly transferred via the torque converter clutch to an input shaft 270 of transmission 208. Alternatively, the torque converter lock-up clutch 212 may be partially engaged, thereby enabling the amount of power directly relayed to the transmission to be adjusted. The transmission controller 254 may be configured to adjust the amount of power transmitted by torque converter 212 by adjusting the torque converter lock-up clutch in response to various engine operating conditions, or based on a driver-based engine operation request.

Torque converter 206 also includes pump 283 that pressurizes fluid to operate disconnect clutch 236, forward clutch 210, and gear clutches 211. Pump 283 is driven via impeller 285, which rotates at a same speed as ISG 240.

Automatic transmission 208 includes gear clutches (e.g., gears 1-10) 211 and forward clutch 210. Automatic transmission 208 is a fixed ratio transmission. Alternatively, transmission 208 may be a continuously variable transmission that has a capability of simulating a fixed gear ratio transmission and fixed gear ratios. The gear clutches 211 and the forward clutch 210 may be selectively engaged to change a ratio of an actual total number of turns of input shaft 270 to an actual total number of turns of wheels 216. Gear clutches 211 may be engaged or disengaged via adjusting fluid supplied to the clutches via shift control solenoid valves 209. Power output from the automatic transmission 208 may also be relayed to wheels 216 to propel the vehicle via output shaft 260. Specifically, automatic transmission 208 may transfer an input driving power at the input shaft 270 responsive to a vehicle traveling condition before transmitting an output driving power to the wheels 216. Transmission controller 254 selectively activates or engages TCC 212, gear clutches 211, and forward clutch 210. Transmission controller also selectively deactivates or disengages TCC 212, gear clutches 211, and forward clutch 210.

Further, a frictional force may be applied to wheels 216 by engaging friction wheel brakes 218. In one example, friction wheel brakes 218 may be engaged in response to a human driver pressing their foot on a brake pedal (not shown) and/or in response to instructions within brake controller 250. Further, brake controller 250 may apply brakes 218 in response to information and/or requests made by vehicle system controller 255. In the same way, a frictional force may be reduced to wheels 216 by disengaging wheel brakes 218 in response to the human driver releasing their foot from a brake pedal, brake controller instructions, and/or vehicle system controller instructions and/or information. For example, vehicle brakes may apply a frictional force to wheels 216 via controller 250 as part of an automated engine stopping procedure.

In response to a request to accelerate vehicle 225, vehicle system controller may obtain a driver demand power or power request from an accelerator pedal or other device. Vehicle system controller 255 then allocates a fraction of the requested driver demand power to the engine and the remaining fraction to the ISG or BISG. Vehicle system controller 255 requests the engine power from engine controller 12 and the ISG power from electric machine controller 252. If the ISG power plus the engine power is less than a transmission input power limit (e.g., a threshold value not to be exceeded), the power is delivered to torque converter 206 which then relays at least a fraction of the requested power to transmission input shaft 270. Transmission controller 254 selectively locks torque converter clutch 212 and engages gears via gear clutches 211 in response to shift schedules and TCC lockup schedules that may be based on input shaft power and vehicle speed. In some conditions when it may be desired to charge electric energy storage device 275, a charging power (e.g., a negative ISG power) may be requested while a non-zero driver demand power is present. Vehicle system controller 255 may request increased engine power to overcome the charging power to meet the driver demand power.

In response to a request to decelerate vehicle 225 and provide regenerative braking, vehicle system controller may provide a negative desired wheel power (e.g., desired or requested powertrain wheel power) based on vehicle speed and brake pedal position. Vehicle system controller 255 then allocates a fraction of the negative desired wheel power to the ISG 240 and the engine 10. Vehicle system controller may also allocate a portion of the requested braking power to friction brakes 218 (e.g., desired friction brake wheel power). Further, vehicle system controller may notify transmission controller 254 that the vehicle is in regenerative braking mode so that transmission controller 254 shifts gears 211 based on a unique shifting schedule to increase regeneration efficiency. Engine 10 and ISG 240 may supply a negative power to transmission input shaft 270, but negative power provided by ISG 240 and engine 10 may be limited by transmission controller 254 which outputs a transmission input shaft negative power limit (e.g., not to be exceeded threshold value). Further, negative power of ISG 240 may be limited (e.g., constrained to less than a threshold negative threshold power) based on operating conditions of electric energy storage device 275, by vehicle system controller 255, or electric machine controller 252. Any portion of desired negative wheel power that may not be provided by ISG 240 because of transmission or ISG limits may be allocated to engine 10 and/or friction brakes 218 so that the desired wheel power is provided by a combination of negative power (e.g., power absorbed) via friction brakes 218, engine 10, and ISG 240.

Accordingly, power control of the various powertrain components may be supervised by vehicle system controller 255 with local power control for the engine 10, transmission 208, electric machine 240, and brakes 218 provided via engine controller 12, electric machine controller 252, transmission controller 254, and brake controller 250.

As one example, an engine power output may be controlled by adjusting a combination of spark timing, fuel pulse width, fuel pulse timing, and/or air charge, by controlling throttle opening and/or valve timing, valve lift and boost for turbo- or super-charged engines. In the case of a diesel engine, controller 12 may control the engine power output by controlling a combination of fuel pulse width, fuel pulse timing, and air charge. Engine braking power or negative engine power may be provided by rotating the engine with the engine generating power that is insufficient to rotate the engine. Thus, the engine may generate a braking power via operating at a low power while combusting fuel, with one or more cylinders deactivated (e.g., not combusting fuel), or with all cylinders deactivated and while rotating the engine. The amount of engine braking power may be adjusted via adjusting engine valve timing. Engine valve timing may be adjusted to increase or decrease engine compression work. Further, engine valve timing may be adjusted to increase or decrease engine expansion work. In all cases, engine control may be performed on a cylinder-by-cylinder basis to control the engine power output.

Electric machine controller 252 may control power output and electrical energy production from ISG 240 by adjusting current flowing to and from field and/or armature windings of ISG as is known in the art.

Transmission controller 254 receives transmission input shaft position via position sensor 271. Transmission controller 254 may convert transmission input shaft position into input shaft speed via differentiating a signal from position sensor 271 or counting a number of known angular distance pulses over a predetermined time interval. Transmission controller 254 may receive transmission output shaft torque from torque sensor 272. Alternatively, sensor 272 may be a position sensor or torque and position sensors. If sensor 272 is a position sensor, controller 254 may count shaft position pulses over a predetermined time interval to determine transmission output shaft velocity. Transmission controller 254 may also differentiate transmission output shaft velocity to determine transmission output shaft acceleration. Transmission controller 254, engine controller 12, and vehicle system controller 255, may also receive addition transmission information from sensors 277, which may include but are not limited to pump output line pressure sensors, transmission hydraulic pressure sensors (e.g., gear clutch fluid pressure sensors), ISG temperature sensors, and BISG temperatures, gear shift lever sensors, and ambient temperature sensors. Transmission controller 254 may also receive requested gear input from gear shift selector 290 (e.g., a human/machine interface device). Gear shift lever may include positions for gears 1-N (where N is the an upper gear number), D (drive), and P (park).

Brake controller 250 receives wheel speed information via wheel speed sensor 221 and braking requests from vehicle system controller 255. Brake controller 250 may also receive brake pedal position information from brake pedal sensor 154 shown in FIG. 1 directly or over CAN 299. Brake controller 250 may provide braking responsive to a wheel power command from vehicle system controller 255. Brake controller 250 may also provide anti-lock and vehicle stability braking to improve vehicle braking and stability. As such, brake controller 250 may provide a wheel power limit (e.g., a threshold negative wheel power not to be exceeded) to the vehicle system controller 255 so that negative ISG power does not cause the wheel power limit to be exceeded. For example, if controller 250 issues a negative wheel power limit of 50 N-m, ISG power is adjusted to provide less than 50 N-m (e.g., 49 N-m) of negative power at the wheels, including accounting for transmission gearing.

Thus, the system of FIGS. 1 and 2 provides for a system, comprising: an engine including an exhaust system with an exhaust tuning valve; and a controller including executable instructions stored in non-transitory memory that cause the controller to rotate the engine from a position where the engine is not rotating in response to an ambient temperature being within a threshold temperature at which water freezes. The system further comprises additional instructions to adjust a position of the exhaust tuning valve in response to the ambient temperature being within the threshold temperature at which water freezes. The system further comprises additional instructions to adjust the position of the exhaust tuning valve in further response to an ambient humidity. The system further comprises additional instructions to adjust a minimum opening amount of the exhaust tuning valve in response to the ambient temperature. The system further comprises a circuit to activate the controller in response to the ambient temperature and an ambient humidity. The system includes where the circuit includes a humidity sensor and a temperature sensor. The system includes where the circuit includes two comparators. The system includes where the engine is rotated whether or not a vehicle in which the engine resides is activated or deactivated.

Figure 4:
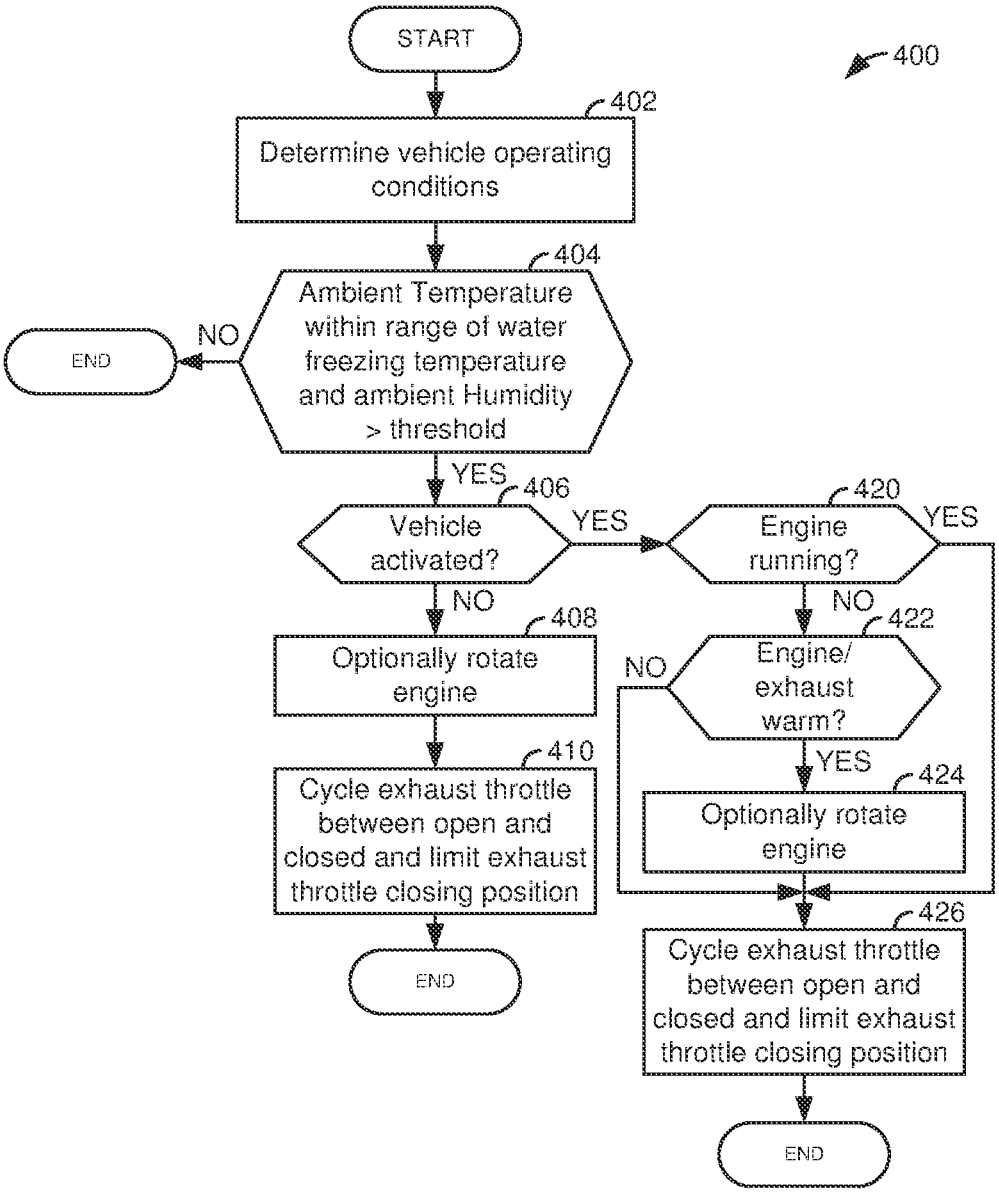
FIG. 4 shows a flowchart of a method for operating a vehicle.
Figure 5:
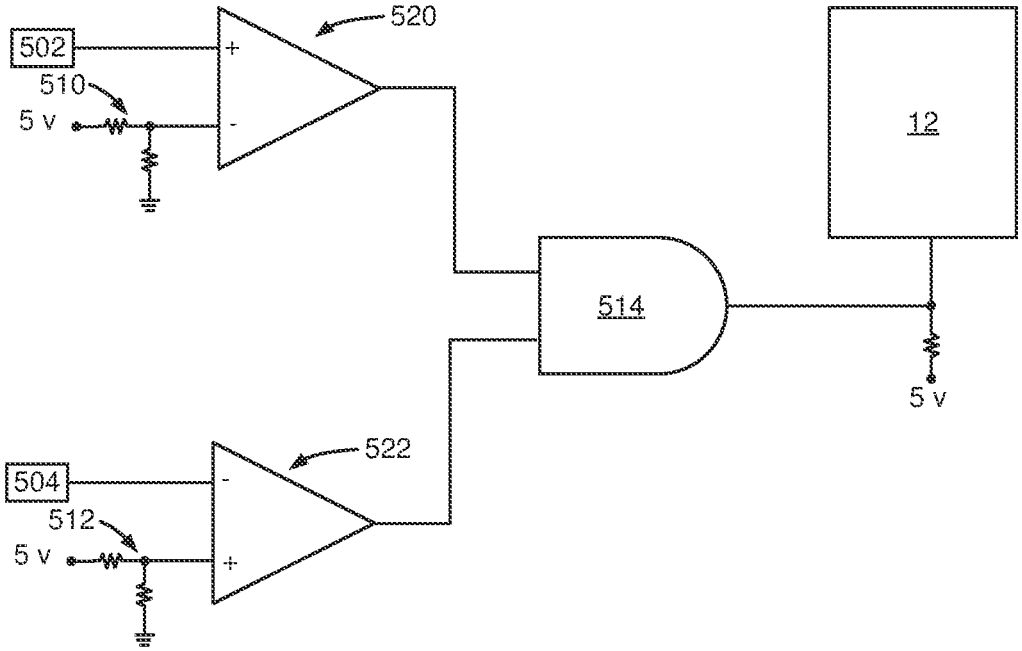
FIG. 5 shows a schematic of an example circuit for waking-up a controller to adjust a position of a valve in an exhaust system of a vehicle.

Referring now to FIG. 3, an example vehicle operating sequence according to the method of FIG. 4 is shown. The operating sequence may be performed via the system of FIGS. 1 and 2 in cooperation with the method of FIG. 4. Vertical lines at times t0-t6 represent times of interest during the sequence. The plots of FIG. 3 are time aligned.

The first plot from the top of FIG. 3 is a plot of ambient temperature versus time. The vertical axis represents ambient temperature and ambient temperature increases in the direction of the vertical axis arrow. The horizontal axis represents time and time increases from the left side of the figure to the right side of the figure. Solid line 302 represents ambient temperature. Horizontal line 352 represents a temperature at which water freezes (e.g., 0° C.). Horizontal line 350 represents a temperature that is within a threshold temperature (e.g., 3° C.) of the temperature that is represented by horizontal line 352.

The second plot from the top of FIG. 3 is a plot of ambient relative humidity versus time. The vertical axis represents percentage of ambient relative humidity (e.g., 0-100%) and the amount of ambient relative humidity increases in the direction of the vertical axis arrow. The horizontal axis represents time and time increases from the left side of the figure to the right side of the figure. Solid line 304 represents an amount of ambient relative humidity. Horizontal line 454 represents a threshold relative ambient humidity.

The third plot from the top of FIG. 3 is a plot of a vehicle operating state versus time. The vertical axis represents the vehicle operating state and the vehicle is on (e.g., one or more propulsion devices are activated and deliver propulsive effort on demand) when trace 306 is at a higher level near the vertical axis arrow. The vehicle is off and is not prepared to deliver propulsive effort when trace 306 is at a lower level that is near the horizontal axis. The horizontal axis represents time and time increases from the left side of the figure to the right side of the figure. Trace 306 represents the vehicle operating state.

The fourth plot from the top of FIG. 3 is a plot of engine operating state versus time. The vertical axis represents the engine operating state and the engine is on (e.g., rotating and combusting fuel) when trace 308 is at a higher level near the vertical axis arrow. The engine is off (e.g., not combusting fuel) when trace 308 is at a lower level near the horizontal axis. The horizontal axis represents time and time increases from the left side of the figure to the right side of the figure. Trace 308 represents the engine operating state.

The fifth plot from the top of FIG. 3 is a plot of exhaust tuning valve positon versus time. The exhaust tuning valve is fully open when trace 310 is at the level of the label FO along the vertical axis. The exhaust valve is fully closed when trace 310 is at the level of the label FC along the vertical axis. The horizontal axis represents time and time increases from the left side of the figure to the right side of the figure. Trace 310 represents the position of the exhaust tuning valve.

The sixth plot from the top of FIG. 3 is a plot of engine rotation state versus time. The vertical axis represents the engine rotation operating state and the engine is rotating when trace 312 is at a higher level near the vertical axis arrow. The engine is not rotating when trace 312 is at a lower level near the horizontal axis. The horizontal axis represents time and time increases from the left side of the figure to the right side of the figure. Trace 312 represents the engine rotation operating state.

At time t0, the ambient temperature is greater than threshold 350 and the ambient humidity is greater than threshold 304. The vehicle is activated and the engine is on and rotating. The exhaust tuning valve is fully closed. The ambient temperature falls between time t0 and time t1.

At time t1, the ambient temperature is less than threshold 350 and greater than threshold 352. Thus, the ambient temperature is within a threshold temperature of a temperature at which water freezes. The ambient humidity is unchanged. Such conditions may be indicative of water condensing and freezing the exhaust tuning valve to the exhaust system. Therefore, the exhaust tuning valve is commanded open in response to the ambient temperature and ambient humidity. The opening amount of the exhaust tuning valve may be a function of ambient temperature and the vehicle operating state. In this example, the exhaust tuning valve is opened partially (e.g., 10% of full scale) so that exhaust noise may be less pronounced as compared to if the exhaust valve were fully opened. In addition, the minimum opening amount of the exhaust tuning valve is increased so that the exhaust tuning valve remains partially open. Leaving the exhaust valve partially open may reduce the possibility of the exhaust tuning valve freezing and may make it easier to open the exhaust tuning valve if the exhaust tuning valve does freeze. The engine is operating and it continues to rotate.

At time t2, the ambient temperature is reduced to a level that is below threshold 352. Therefore, the exhaust tuning valve is again partially opened and closed to the exhaust tuning valve closing limit. The ambient humidity is unchanged and the vehicle continues to operate. The engine is on and the engine continues to rotate.

At time t3, the engine is stopped and it stops rotating shortly thereafter. The vehicle remains activated and the ambient temperature is less than threshold 352. The ambient humidity is unchanged and the exhaust tuning valve opening amount is positioned at the minimum opening limit. The vehicle state changes from active or on to off between time t3 and time t4.

At time t4, the ambient temperature has increase to a level that is above threshold 350. The ambient humidity is unchanged and the vehicle is reactivated. The engine is also restarted at time t4 and the exhaust tuning valve is held at its minimum opening amount. The engine's exhaust tuning valve is returned to its fully closed position and the engine rotates as it is started.

Between time t4 and time t5, the engine is stopped and it stops rotating. Ambient temperature remains above threshold 350 and ambient humidity is unchanged. The exhaust tuning valve remains fully closed.

At time t5, the vehicle is deactivated and the ambient temperature remains above threshold 350. The ambient humidity is unchanged and the engine is off and not rotating. The exhaust tuning valve is fully closed.

At time t6, the ambient temperature falls below threshold 350 while the ambient humidity is unchanged. The lower ambient temperature causes the vehicle's controller (not shown) to activate and open the exhaust tuning valve. In addition, the engine is rotated via an electric machine (e.g., 240 of FIG. 2). The engine is rotated so that residual heat in the engine and exhaust system may be utilized to remove water from near the exhaust tuning valve if water is near the valve. The exhaust tuning valve is opened and closed twice. The exhaust tuning valve opening amount may be a function of ambient temperature and vehicle operating state. For example, the exhaust tuning valve may be commanded to a more open position when the engine is not on as compared to when the engine is off so as to mitigate increasing exhaust noise. Further, the exhaust tuning valve may be opened more at lower ambient temperatures as compared to opening the exhaust tuning valve a warmer temperatures. The exhaust tuning valve is also maintained at a position that is greater than a minimum exhaust tuning valve opening amount. The engine rotation is stopped and the exhaust tuning valve is moved to its minimum opening position shortly after time t5.

In this way, a position of an exhaust tuning valve may be adjusted to reduce a possibility of a stuck valve. By moving the exhaust tuning valve, ice that may be forming on the valve may be broke so that the exhaust tuning valve may move freely. In addition, the exhaust tuning valve may be held partially open at a minimum exhaust tuning valve opening amount so that there may be less opportunity for ice to attach the exhaust tuning valve to the exhaust system.

Referring now to FIG. 4, a flow chart of a method for operating an engine with an exhaust tuning valve is shown. The method of FIG. 4 may be incorporated into and may cooperate with the system of FIGS. 1 and 2. Further, at least portions of the method of FIG. 4 may be incorporated as executable instructions stored in non-transitory memory while other portions of the method may be performed via a controller transforming operating states of devices and actuators in the physical world.

At 402, method 400 determines vehicle operating conditions. Vehicle operating conditions may include but are not limited to engine speed, ambient temperature, ambient humidity, vehicle speed, engine temperature, engine load, and driver demand torque or power. Method 400 proceeds to 404.

At 404, method 400 judges if present ambient temperature is within a threshold temperature range of a temperature at which water freezes and if present ambient humidity is greater than a threshold humidity. For example, if the ambient temperature threshold is 3° C. and present ambient temperature is 2° C., then the present ambient temperature is within the threshold temperature at which water freezes 0° C. If present ambient relative humidity is 50% and the humidity threshold is 45% relative humidity, then the present ambient relative humidity is greater than the humidity threshold. If method 400 judges that ambient temperature is within a threshold temperature range of a temperature at which water freezes and if present ambient humidity is greater than a threshold humidity, the answer is yes and method 400 proceeds to 406. Otherwise, the answer is no and method 400 proceeds to exit. In one example, the conditions of 404 may be determined via the circuit shown in FIG. 5. The circuit of FIG. 5 may cause the vehicle controller 12 to wake from a sleep (e.g., low activity state) to perform the actions that are described herein.

At 406, method 400 judges if the vehicle that includes the exhaust tuning valve is activated. The vehicle may be activated when one or more of the vehicle's propulsion devices is prepared to respond to driver demand input. If method 400 judges that the vehicle is activated, the answer is yes and method 400 proceeds to 420. Otherwise, the answer is no and method 400 proceeds to 408.

At 408, method 400 may rotate the vehicle's engine via an electric machine (e.g., 240 of FIG. 2 or 96 of FIG. 1). In one example, method 400 may rotate the engine if it is determined that there is heat in the engine or exhaust system that may aid in evaporation of water that may be near the exhaust tuning valve. Method 400 may judge if there is heat in the engine and exhaust system via a temperature sensor. The engine may be rotated without supplying fuel to the engine, thereby pumping warmed air to the engine with exhaust that may contain fewer hydrocarbons. Method 400 proceeds to 410.

At 410, method 400 cycles the exhaust tuning valve from a first position (more closed) to a second position (more open). The exhaust tuning valve may be cycled a plurality of times so that water that may be near crystalizing may be removed from the exhaust tuning valve. In addition, the exhaust tuning valve's minimum opening position (e.g., a minimum amount that the exhaust tuning valve has to stay open) may be increased so that the exhaust tuning valve does not fully close. For example, during nominal operating conditions the exhaust tuning valve may fully close when the valve's minimum opening position is small. However, the exhaust tuning valve may be held 10% open when ambient temperature is near a temperature at which water may freeze. Method 400 proceeds to exit.

At 420, method 400 judges if the vehicle's engine is running (e.g., rotating and combusting fuel). If so, the answer is yes and method 400 proceeds to 426. Otherwise, the answer is no and method 400 proceeds to 422.

At 422, method 400 judges if the engine and/or exhaust system are warm. In one example, method 400 may judge if the engine temperature is greater than a threshold temperature. If so, the answer is yes and method 400 proceeds to 424. Otherwise, the answer is no and method 400 proceeds to 426. Method 400 may determine whether or not the engine is warm so that it may be established if there is sufficient heat in the engine and exhaust system to warm water that may be in the exhaust system.

At 424, method 400 may rotate the vehicle's engine via an electric machine (e.g., 240 of FIG. 2 or 96 of FIG. 1). The engine may be rotated without supplying fuel to the engine, thereby pumping warmed air to the engine with exhaust that may contain fewer hydrocarbons. Method 400 proceeds to 426.

At 426, method 400 cycles the exhaust tuning valve from a first position (more closed) to a second position (more open). The exhaust tuning valve may be cycled a plurality of times so that water that may be near crystalizing may be removed from the exhaust tuning valve. In addition, the exhaust tuning valve's minimum opening position (e.g., a minimum amount that the exhaust tuning valve has to stay open) may be increased so that the exhaust tuning valve does not fully close. Method 400 proceeds to exit.

In this way, a position of an exhaust tuning valve may be adjusted before a present ambient temperature is reduced to a temperature at which water may freeze. As such, preemptive clearing of the exhaust tuning valve may be possible so that water may be removed from the exhaust tuning valve. In addition, if water does freeze near the exhaust tuning valve, there may be less ice to remove if the water freezes since moving the exhaust tuning valve may cause water to shed from the valve. Further, a minimum opening position of the exhaust tuning valve may be increased so that water may have to span a further distance to cause the exhaust tuning valve to stick.

Thus, the method of FIG. 4 provides for a method for operating an engine, comprising: adjusting a position of a valve in an exhaust system of the engine via a controller in response to ambient temperature being within a threshold temperature of a temperature at which water freezes and ambient relative humidity being greater than a threshold relative humidity. The method includes where the threshold relative humidity is greater than 50% relative humidity. The method further comprises increasing a minimum opening amount of the valve in response to the ambient temperature being within a threshold temperature of the temperature at which water freezes. The method further comprises decreasing the minimum opening amount of the valve in response to the ambient temperature being greater than the threshold temperature plus the temperature at which water freezes. The method includes where adjusting the position of the valve includes commanding the valve to cycle from a more closed position to a more open position. The method further comprises rotating the engine from a position where the engine is not rotating in response to the ambient temperature being within the threshold temperature of the temperature at which water freezes and ambient humidity being greater than the threshold humidity. The method includes where the a vehicle in which the engine resides is not activated when the engine is at the position where the engine is not rotating.

The method of FIG. 4 also provides for a method for operating an engine, comprising: adjusting a position of a valve in an exhaust system of the engine via a controller in response to an ambient temperature being within a threshold temperature of a temperature at which water freezes, where adjusting the position includes increasing a minimum opening amount of the valve. The method further comprises rotating the engine in response to the ambient temperature being within the threshold temperature of the temperature at which water freezes. The method includes where adjusting the position includes cycling the valve from a first position to a second position, where the first position is more closed than the second position. The method further comprises varying a commanded opening amount of the valve in response to the ambient temperature. The method further comprises varying a commanded opening amount of the valve in response to an ambient humidity.

Referring now to FIG. 5, a schematic diagram of an example circuit for waking a controller 12 that is in a sleeping mode (e.g., low energy consumption mode with limited capability) is shown. The circuit includes a first comparator 520 and a second comparator 522. The first comparator 520 receives a voltage output of temperature sensor 170, which is indicative of ambient temperature, at its positive terminal, which is denoted "+." The first comparator 520 also receives a voltage output of a voltage divider circuit 510 that is indicative of a voltage at which water may freeze plus an offset temperature or temperature range (e.g., 0.5 volts=0° C.+2° C.) at its negative terminal, which is denoted "−." First comparator 520 outputs a value that is equal to logical 1 when a voltage at its positive terminal is greater than a voltage that is at its negative terminal. First comparator 520 outputs a value that is equal to logical 0 when a voltage at its positive terminal is less than a voltage that is at its negative terminal. Therefore, whenever ambient temperature is less than 0° C. plus an offset temperature or a threshold temperature range, first comparator outputs a logical zero.

The second comparator 522 receives a voltage output of humidity sensor 172, which is indicative of ambient temperature, at its negative terminal, which is denoted "−." The second comparator 522 also receives a voltage output of a voltage divider circuit 512 that is indicative of a voltage that is output by the humidity sensor at a particular humidity or relative humidity level (e.g., 50% relative humidity) at its positive terminal, which is denoted "+." Second comparator 522 outputs a value that is equal to logical 1 when a voltage at its positive terminal is greater than a voltage that is at its negative terminal. Second comparator 522 outputs a value that is equal to a logical 0 when a voltage at its positive terminal is less than a voltage that is at its negative terminal. Therefore, whenever ambient humidity is greater than the humidity level that is represented by the voltage that is output of voltage divider 512, second comparator 522 outputs a logical zero.

The output of first comparator 520 and the output of second comparator 522 are input to AND gate 514. The AND gate 514 outputs a logical zero and it pulls the voltage that is input to controller 12 down to ground level when ambient temperature is less than a temperature at which water freezes plus an offset or threshold temperature and when ambient humidity is greater than a threshold humidity. The controller 12 may be waked from a sleep state when it receives a low level input. The controller may open and close the exhaust tuning throttle in response to being awakened. In addition, the controller may rotate an engine without fueling the engine via an electric machine in response to being awakened.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. A method for operating an engine, comprising:

adjusting a position of a valve in an exhaust system of the engine via a controller in response to ambient temperature being within a threshold temperature of a temperature at which water freezes and ambient relative humidity being greater than a threshold relative humidity.

2. The method of claim 1, where the threshold relative humidity is greater than 50% relative humidity.

3. The method of claim 1, further comprising increasing a minimum opening amount of the valve in response to the ambient temperature being within a threshold temperature of the temperature at which water freezes.

4. The method of claim 3, further comprising decreasing the minimum opening amount of the valve in response to the ambient temperature being greater than the threshold temperature plus the temperature at which water freezes.

5. The method of claim 1, where adjusting the position of the valve includes commanding the valve to cycle from a more closed position to a more open position.

6. The method of claim 1, further comprising rotating the engine from a position where the engine is not rotating in response to the ambient temperature being within the threshold temperature of the temperature at which water freezes and ambient humidity being greater than the threshold relative humidity.

7. The method of claim 6, where a vehicle in which the engine resides is not activated when the engine is at the position where the engine is not rotating.

8. A system, comprising:

an engine including an exhaust system with an exhaust tuning valve; and a controller including executable instructions stored in non-transitory memory that cause the controller to rotate the engine without supplying fuel to the engine from a position where the engine is not rotating in response to an ambient temperature being within a threshold temperature at which water freezes and ambient humidity.

9. The system of claim 8, further comprising additional instructions to adjust a position of the exhaust tuning valve in response to the ambient temperature being within the threshold temperature at which water freezes.

10. The system of claim 8, further comprising additional instructions to adjust a minimum opening amount of the exhaust tuning valve in response to the ambient temperature.

11. The system of claim 8, further comprising a circuit to activate the controller in response to the ambient temperature and an ambient humidity.

12. The system of claim 11, where the circuit includes a humidity sensor and a temperature sensor.

13. The system of claim 12, where the circuit includes two comparators.

14. The system of claim 8, where the engine is rotated whether or not a vehicle in which the engine resides is activated or deactivated.

15. A method for operating an engine, comprising:

adjusting a position of a valve in an exhaust system of the engine via a controller in response to an ambient temperature being within a threshold temperature of a temperature at which water freezes, where adjusting the position includes increasing a minimum opening amount of the valve; and rotating the engine without supplying fuel to the engine in response to an engine temperature greater than a threshold temperature and the ambient temperature being within the threshold temperature of the temperature at which water freezes.

16. The method of claim 15, further comprising pumping warmed air through the engine.

17. The method of claim 15, where adjusting the position includes cycling the valve from a first position to a second position, where the first position is more closed than the second position.

18. The method of claim 15, further comprising varying a commanded opening amount of the valve in response to the ambient temperature.

19. The method of claim 15, further comprising varying a commanded opening amount of the valve in response to an ambient humidity.

* * * * *